United States Patent [19]

Sethi et al.

[11] 4,052,921

[45] Oct. 11, 1977

[54] APPARATUS FOR REMOVING WEBS FROM CARTRIDGES

[75] Inventors: Gurdip Singh Sethi, Rochester; Thomas Walter Cole, Avon, both of N.Y.

[73] Assignee: Eastman Kodak Company, Rochester, N.Y.

[21] Appl. No.: 737,259

[22] Filed: Oct. 29, 1976

[51] Int. Cl.[2] ..... B26D 7/06

[52] U.S. Cl. ..... 83/409; 83/435.2; 83/649; 226/92; 226/172

[58] Field of Search ..... 83/409, 435.2, 649, 83/650; 226/92, 172

[56] References Cited

U.S. PATENT DOCUMENTS

| | | | |
|---|---|---|---|
| 3,177,746 | 4/1965 | Langer | 83/409 X |
| 3,780,922 | 12/1973 | Bloemendahl et al. | 226/92 |
| 3,807,264 | 4/1974 | Jessop | 83/649 X |

*Primary Examiner*—Donald R. Schran
*Attorney, Agent, or Firm*—S. W. Gremban

[57] ABSTRACT

Apparatus is disclosed for pulling webs of random lengths from respective cartridges. Each web has an end portion which protrudes from its respective cartridge. The cartridges are advanced by an endless belt cartridge conveyor in a first direction while the web end portions are sandwiched between a pair of endless belt conveyors and advanced in a second direction at an acute angle with respect to the first direction. Due to such divergent advancement of the cartridges and the web end portions, the webs are pulled from the cartridges. A cutting wheel is provided to cut the web after being pulled from the cartridges.

9 Claims, 5 Drawing Figures

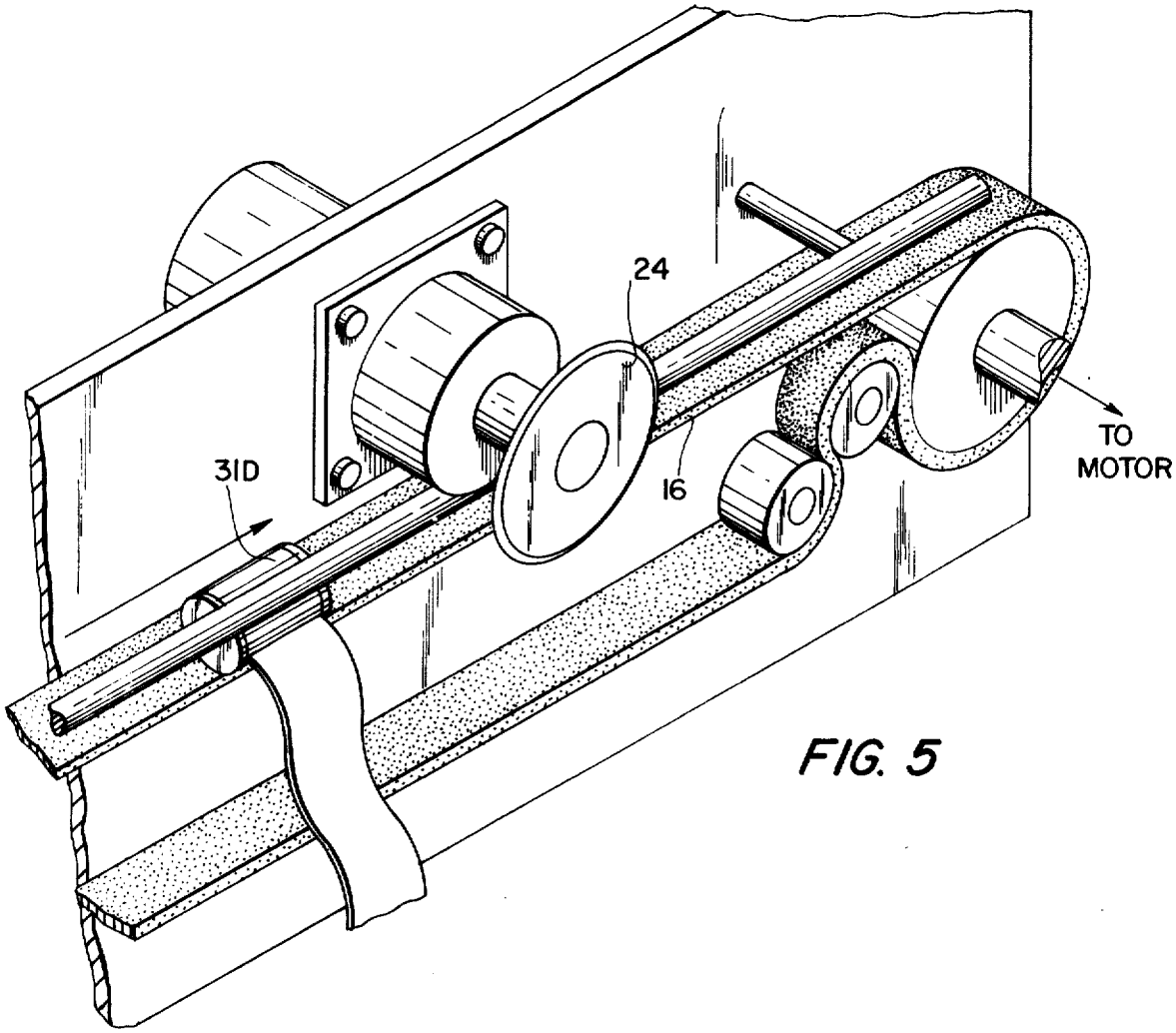
FIG. 5
FIG. 2
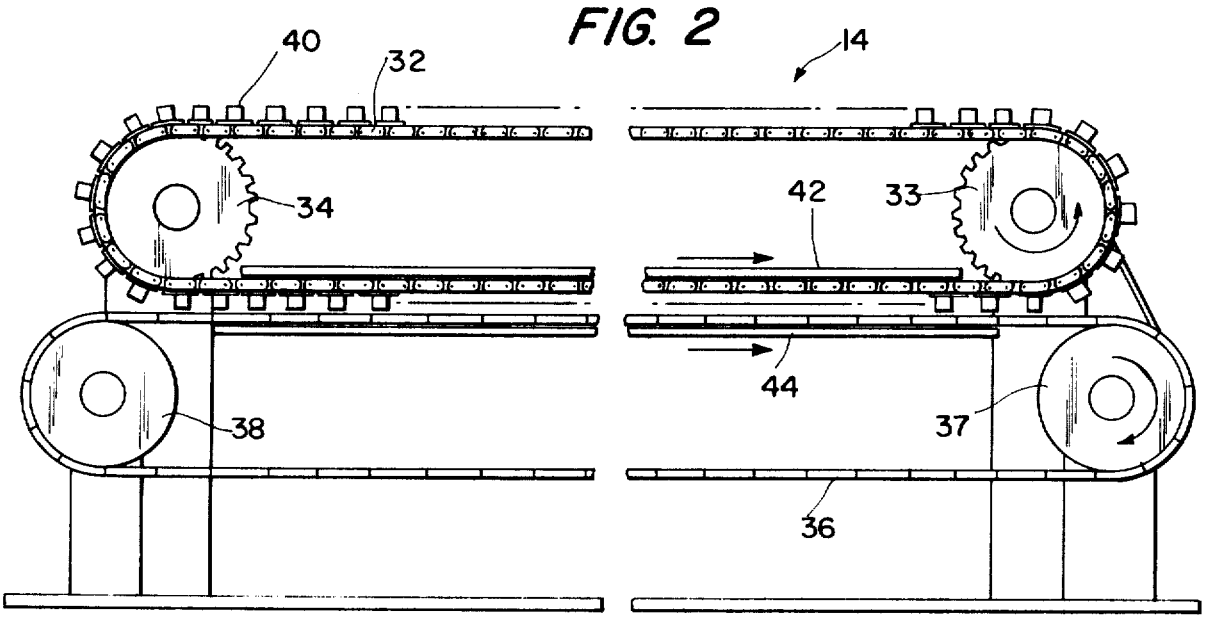

APPARATUS FOR REMOVING WEBS FROM CARTRIDGES

BACKGROUND OF THE INVENTION

1. Field of the Invention

The present invention relates to apparatus for removing webs from cartridges, and more particularly to such apparatus wherein the webs are pulled from the cartridges and then cut.

2. Description Relative to the Prior Art

When manufacturing cartridges containing webs, it is desirable, due to manufacturing imperfections in the cartridges or webs, to be able to remove the webs from the cartridges for purposes of recycling the webs and/or cartridges. As an example, when manufacturing cartridges containing film, certain defects in the film or cartridge may result in a finished film cartridge unsuitable for sale. In such a case, the film cartridge may be thrown away thereby wasting the raw material contained therein. Or, and preferably, an attempt can be made to salvage some or all of the film cartridge components, including the film. While apparatus are currently known which are capable of recycling the film alone or the cartridge alone, the film must somehow be removed and separated from the cartridge to make use of such apparatus.

Since commercial feasibility of a recycling program depends upon the relative cost of recycling versus the cost of new raw materials, the cost of the recycling process is a critical factor. At present, the film strips are removed from the cartridges manually; i.e., a person grasps a web end portion which protrudes from the cartridge and manually pulls the film straight out from the cartridge. Then, with scissors or other cutting means, the film strip is cut near the film cartridge, thus accomplishing the desired result of separating the film from the cartridge. While the manual process accomplishes the desired result of separating the film from the cartridges, such manual operations are inherently expensive thereby making the recycling of film cartridge components less attractive, at least from a commercial standpoint.

SUMMARY OF THE INVENTION

In accordance with the present invention, apparatus is provided which automatically removes webs from respective cartridges. In a presently preferred embodiment of the invention, the web removal apparatus comprises means for advancing the cartridges in a first direction. Means are provided for engaging web end portions which protrude from the respective cartridges and for advancing the web end portions so engaged in a second direction at an acute angle with respect to the first direction. Thus, as the cartridges and their respective web end portions are divergently advanced, each web is pulled from its respective cartridge.

BRIEF DESCRIPTION OF THE DRAWINGS

In the detailed description of the preferred embodiments of the invention presented below, reference is made to the accompanying drawings, in which:

FIG. 2 is a side elevational view of a portion of the apparatus shown in FIG. 1 for engaging and advancing web and portions;

FIG. 5 is a perspective view of another portion of the apparatus of FIG. 1 showing a cutting wheel for severing the webs from the cartridges.

DESCRIPTION OF THE PREFERRED EMBODIMENTS

Figure 1:
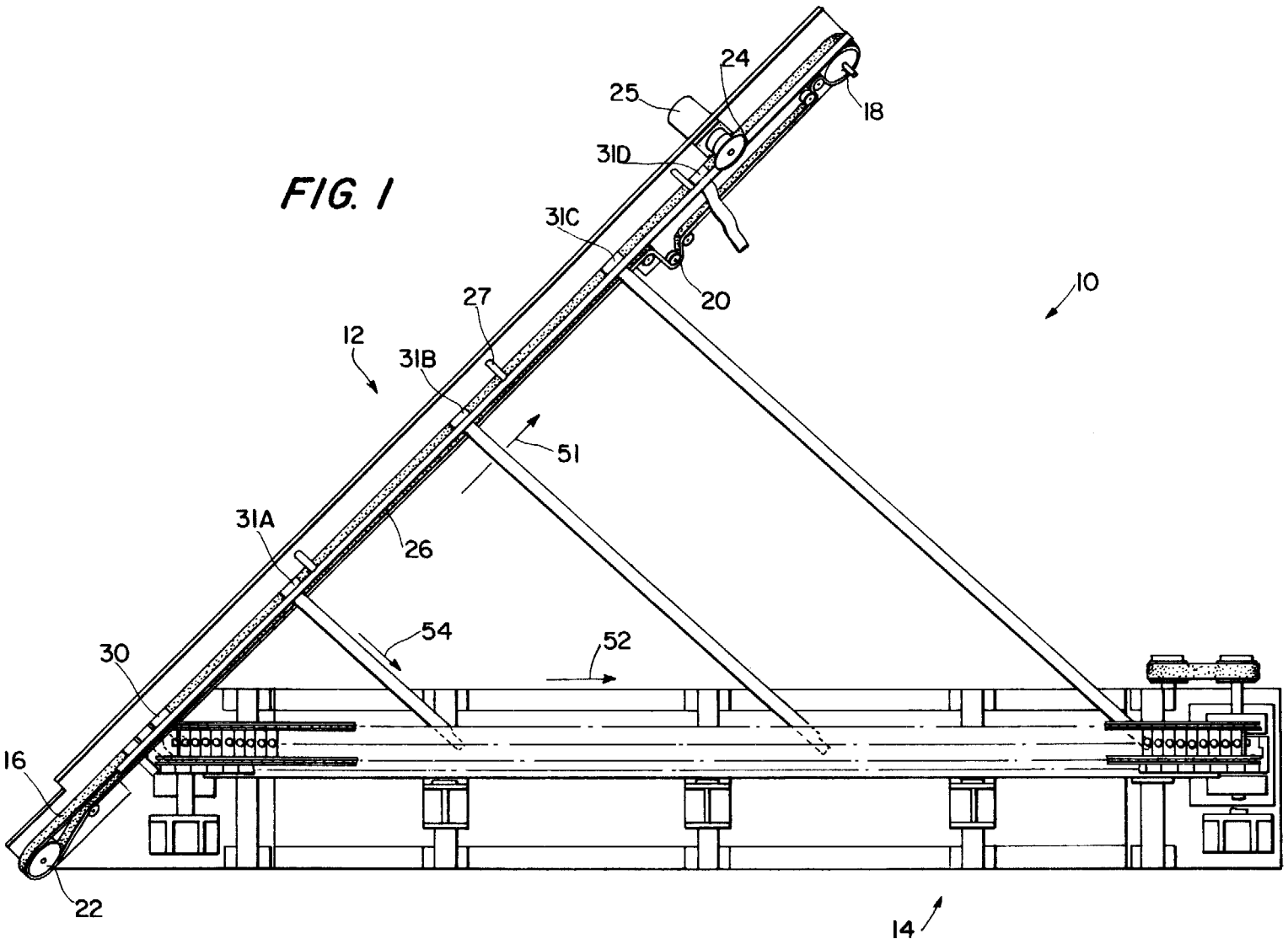
FIG. 1 is a plan view of apparatus in accordance with the invention for removing webs from respective cartridges.

Referring to FIG. 1, a presently preferred embodiment of the invention is shown, generally enumerated 10. For sake of definiteness, the following discussion assumes that the web removal apparatus 10 is to be used for removing film from cartridges, and in particular, the film cartridges are assumed to be the familiar metal cartridges used for amateur or professional 35 mm roll films. It will be apparent to those skilled in the art that the web removal apparatus 10 may be modified to accept other types and sizes of film cartridges, and other types of web cartridges in general.

The web removal apparatus 10 generally comprises two major conveyor assemblies 12 and 14. Conveyor assembly 12 is basically an endless belt conveying system for advancing film cartridges 30 along a conveying belt 16. The conveying belt 16 is driven by a drive roller 18 and guided by an arrangement of guide rollers, one of which is enumerated 20, around a guide roller 22. A cutting wheel 24 (discussed in detail below) driven by a motor 25 is provided for severing film strips which have been pulled from their respective film cartridges. A retaining rail 26 supported by support members 27 (also discussed in more detail below) prevents the film cartridges 30 from being pulled off of the belt 16 during operation of the web removal apparatus 10.

The conveyor assembly 14 is shown in side view in FIG. 2. An endless belt 32 is driven by a drive roller 33 around a guide roller 34, and an endless belt 36 is driven by a driven roller 37 around a guide roller 38. On the surface of the endless belt 32 are a plurality of magnets 40. The endless belt 36 is comprised of a material which is attracted to the magnets 40. Support plates 42 and 44 are provided to ensure proper positioning of the belts 32 and 36. During operation of the conveyor assembly 14, film end portions 50 are placed between the endless belt conveyors 32 and 36. Since the endless belt 32 and the endless belt 36 are mutually magnetically attractive (due to the magnets 40 and the magnetic properties of the belt 36), the film end portion 50 is frictionally engaged upon being sandwiched between the two endless belt conveyors 32 and 36.

Figure 3:
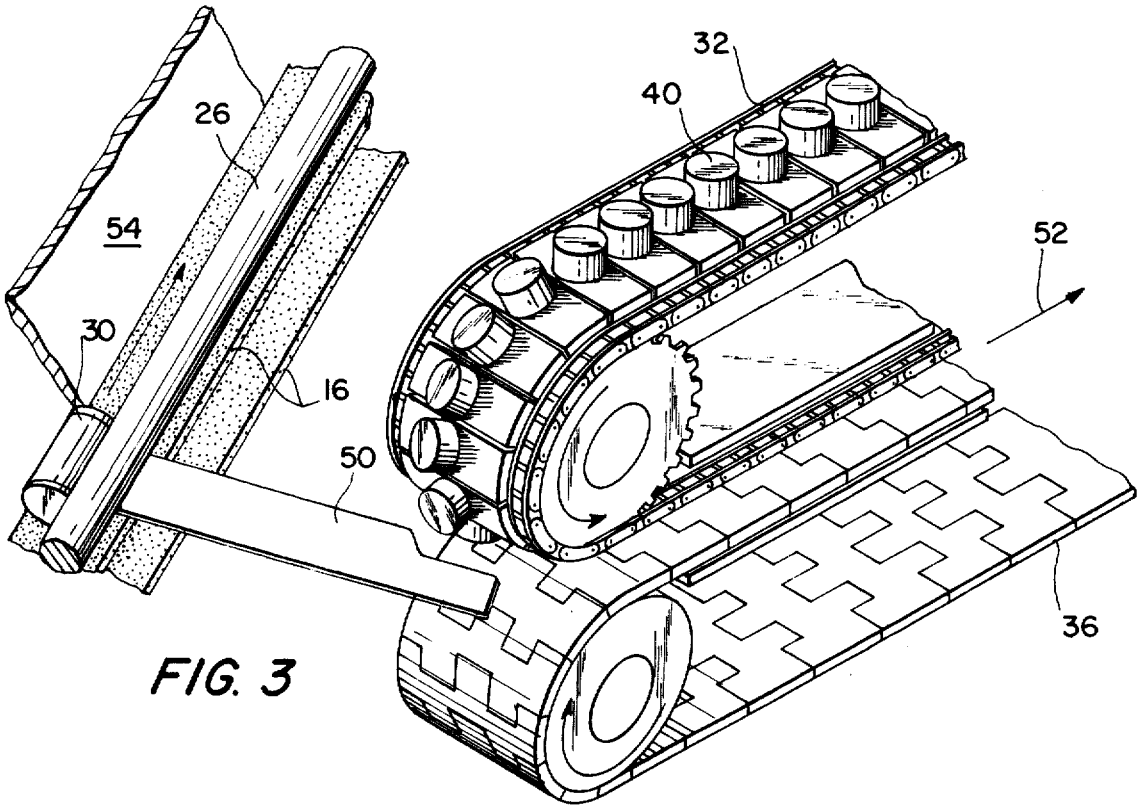
FIG. 3 is a detail drawing of a portion of the apparatus of FIG. 1 showing how web end portions are engaged.

FIG. 3 shows an end portion of the conveyor assembly 14 and specifically how film end portions 50 are fed into and engaged by the conveyor assembly 14. Each cartridge 30 which is placed on the endless belt 16 has a film end portion 50 which protrudes therefrom. Due to the placement of the conveyor assemblies 12 and 14, each film end portion 50 becomes sandwiched between the endless belt conveyors 32 and 36 as the cartridges are advanced by the conveyor assembly 12. Due to the mutually magnetic attractive character of the belts 32 and 36, the film end portion 50 becomes engaged by the conveyor assembly 14 and is advanced in the direction indicated by an arrow 52.

Figure 4:
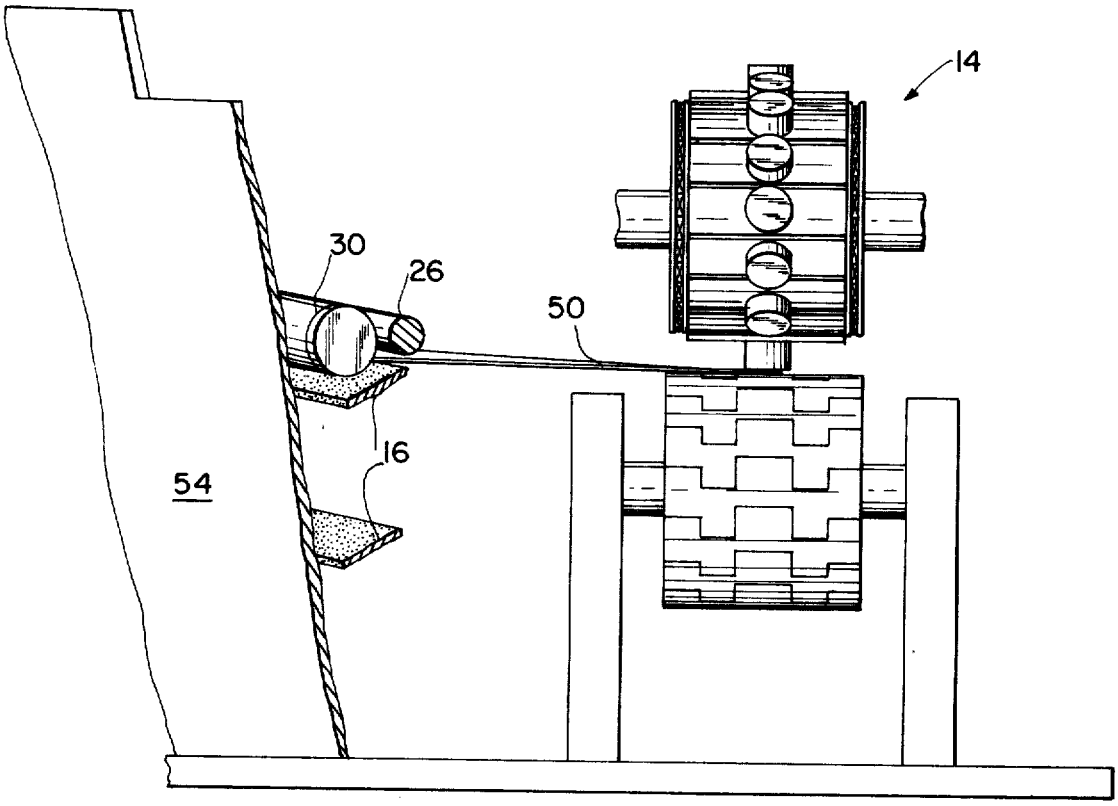
FIG. 4 is a partial elevational view of the apparatus of FIG. 1 showing the placement of cartridges on a cartridge conveyor.

Simultaneously with the advancement of the film end portion 50 in the direction of arrow 52, each respective cartridge 30 is advanced on the endless belt 16 in the direction indicated by arrow 54 as indicated in FIG. 1. Since the film cartridge 30 would normally tend to slide off the endless belt due to the divergent advancement of the film end portion 50, a retaining rail 26 is provided which restrains the film cartridge 30 from movement in a direction other than in the direction indicated by arrow 51. In FIG. 4, the restraining feature of the retaining rail 26 is clearly shown. The film end portion 50 is being advanced by the conveyor assembly 14 in a direction into the page as viewed from FIG. 4. A pull is thus exerted on the film cartridge 30 along an axis 54 (FIG. 1) which tends to cause the cartridge 30 to follow the film end portion 50. The retaining rail 26 prevents such motion thereby permitting the film cartridge 30 to be advanced along the endless belt 16 in the direction of arrow 51.

Also seen in FIG. 4, the endless belt 16 is tilted away from the conveyor assembly 14. Such tilting of the belt 16 facilitates operation of the web removal apparatus 10 in that as an operator places a plurality of film cartridges 30 on the endless belt 16, the cartridges 30 will come to rest against a support member 54 rather than roll off the front edge of the belt 16.

An important feature of the web removal apparatus 10 is that it is able not only to accommodate a plurality of film cartridges at one time, but also easily handles film cartridges containing film strips of varied lengths. For example, film cartridges generally contain film strips having lengths corresponding to 12, 20 or 36 exposures. Thus, it is desirable to have a single apparatus capable of removing such film strips when the cartridges containing such varying film lengths are placed on the conveyor 16 in a random manner. Otherwise it is necessary for the operator to separate and process separately the cartridges containing film strips of a given length, possibly requiring separate apparatus for each length.

Referring to FIG. 1, a cartridge 31*a* represents the position of advancement wherein a film strip having a length corresponding to 12 exposures is fully pulled from the cartridge 31*a*. Since the corresponding film end portion 50 is only frictionally secured in the conveyor assembly 14, the end portion 50 will be pulled loose from the conveyor assembly 14 (assuming the other end of film strip is taped or otherwise secured inside the film cartridge) and the film strip pulled from the cartridge will then dangle over the edge of the belt 16. The cartridge 31*a* keeps advancing on the belt 16 to a position indicated by cartridge 31*d*. At this position, as shown most clearly in FIG. 5, the dangling film strip is severed from the cartridge 31*d* by a cutting wheel 24. The severed film strip drops into a bin or other receptacle for recycling. The stripped cartridge, on the other hand, continues to advance on belt 16 to the end of the conveyor where it is subsequently deposited in a cartridge receiving bin. Likewise, referring back to FIG. 1, the film cartridges 31*b* and 31*c* represent the position of advancement whereat film strips having lengths corresponding to 20 and 36 exposures respectively would be pulled loose from the conveyor assembly 14. Similar to the cartridge 31*a*, the cartridges 31*b* and 31*c* continue to be advanced on the belt 16 to the cutting wheel 24 (FIG. 5) which severs the dangling film strips from these cartridges. Thus it is seen that due to the divergent advancement of the film end portions 50 and the cartridges 30, the web removal apparatus of FIG. 1 removes webs from a plurality of cartridges even when the cartridges contain randomly varying web lengths.

Depending upon the particular application, there are several modifications which may be made to the web removal apparatus 10. For example, the receiving portion of the endless belt 16 (that portion of the belt 16 upon which film cartridges are loaded by an operator) may be extended indefinitely depending upon how many cartridges it is desired to load upon the belt 16 at one time. With such an extension, an operator may load a large number of cartridges at one time rather than have to place the cartridges one by one on the belt 16. Also, if the film end portion 50 (see FIG. 3) is not stiff enough to entend from cartridge 30 to the conveyor assembly 14, a guide surface may be provided to guide the film end portion 50 to the proper position as indicated in FIG. 3. Still further, the endless belt conveyors 32 and 36 do not have to be mutually magnetically attractive if the frictional engagement of the film end portions 50 between the conveyors 32 and 36 is sufficient to engage and advance the film end portions 50 in the desired direction. The amount of frictional engagement required will depend upon the amount of pull required to remove the film from the film cartridge. The supporting members 42 and 44 likewise are not required in all applications, particularly where the belt 32 and 36 are mutually magnetically attractive. The purpose of the supporting members 42 and 44 is to prevent one of the belts 32 or 36 from sagging, thereby inadvertently releasing the film end portion 50 before the film strip has been completely pulled from the film cartridge. Where the belts 32 and 36 are mutually magnetically attractive, the possibility of one of the belts 32 or 36 sagging and thereby separating from the other is relatively remote.

The invention has been described in detail with particular reference to preferred embodiments thereof, but it will be understood that variations and modifications can be effected within the spirit and scope of the invention. For example, the cutting wheel 24 may be replaced by any other suitable means for cutting the film strip including scissors, or other cutting apparatus.

What is claimed is:

1. Apparatus for pulling webs from respective cartridges, each web having an end portion protruding from its respective cartridge, said apparatus comprising:

means for advancing the cartridges in a first direction; and means for engaging the end portion of each web and for advancing the end portion so engaged in a second direction at an acute angle with respect to said first direction, whereby as the cartridges and the respective web end portions are advanced along said first and second directions respectively, each web is pulled from its respective cartridge.

2. Apparatus as claimed in claim 1 wherein said web end portion engaging means comprises a pair of endless belt conveyors positioned to engage the web end portions therebetween.

3. Apparatus as claimed in claim 2 wherein said pair of endless belt conveyors are mutually magnetically attractive.

4. Apparatus as claimed in claim 3 wherein said cartridge advancing means comprises:

an endless belt cartridge conveyor upon which the cartridge is placed for advancement in said first direction; and a retaining member extending generally along said endless belt cartridge conveyor for retaining the cartridges on said endless belt cartridge conveyor as the respective webs are pulled therefrom.

5. Apparatus as claimed in claim 4 further comprising means for cutting the webs pulled from the cartridges.

6. Apparatus for pulling webs from respective cartridges, each web having an end portion protruding from its respective cartridge, and each web being pullable from its respective cartridge when pulled along a predetermined axis relative to the cartridge, said apparatus comprising:

means for sequentially advancing the cartridges in a first direction and for orienting each cartridge so that the predetermined axis of each cartridge is substantially perpendicular to said first direction; and means for sequentially engaging the end portion of each web and for advancing the end portion so engaged in a second direction at an acute angle with respect to said first direction to assert a pull on each web along the predetermined axis of its respective cartridge.

7. Apparatus as claimed in claim 6 wherein:

said web end portion engaging means comprises a pair of endless belt conveyors positioned to sandwich the web end portions therebetween; and said cartridge advancing means comprises an endless belt cartridge conveyor upon which the cartridge is placed for advancement along said first direction, and a retaining member extending generally along said endless belt cartridge conveyor for retaining the cartridges on said endless belt cartridge conveyor as their respective webs are pulled therefrom.

8. Apparatus as claimed in claim 7 wherein said pair of endless belt conveyors are mutually magnetically attractive.

9. Apparatus as claimed in claim 8 further comprising means for cutting the web pulled from the cartridges.

* * * * *